US009010348B1

(12) United States Patent
Kite

(10) Patent No.: US 9,010,348 B1
(45) Date of Patent: Apr. 21, 2015

(54) AUTOMOBILE DISPLAY CANOPY AND ANCHOR SYSTEM

(71) Applicant: Donald G. Kite, Kansas City, MO (US)

(72) Inventor: Donald G. Kite, Kansas City, MO (US)

( * ) Notice: Subject to any disclaimer, the term of this patent is extended or adjusted under 35 U.S.C. 154(b) by 0 days.

(21) Appl. No.: 14/452,286

(22) Filed: Aug. 5, 2014

Related U.S. Application Data

(63) Continuation-in-part of application No. 14/085,524, filed on Nov. 20, 2013, now abandoned.

(51) Int. Cl.
*E04H 15/06* (2006.01)
*B60J 11/00* (2006.01)
*E04H 15/34* (2006.01)

(52) U.S. Cl.
CPC ..... *E04H 15/34* (2013.01)

(58) Field of Classification Search
CPC ..... E04H 6/04; E04H 15/06; E04H 6/025
USPC ..... 135/88.06, 88.13; 296/136.1, 136.11, 296/136.13
See application file for complete search history.

(56) References Cited

U.S. PATENT DOCUMENTS

| | | | |
|---|---|---|---|
| 2,989,967 A | 6/1961 | Lee | |
| 4,605,030 A | 8/1986 | Johnson | |
| 4,655,236 A | 4/1987 | Dorame et al. | |
| 4,944,321 A | 7/1990 | Moyet-Ortiz | |
| 5,241,977 A | 9/1993 | Flores et al. | |
| 5,295,500 A | 3/1994 | Leu | |
| 5,597,197 A | 1/1997 | Mowar et al. | |
| 6,223,760 B1 | 5/2001 | Hughey | |
| 6,802,327 B2 | 10/2004 | Koss | |
| 6,981,509 B2 | 1/2006 | Sharapov | |
| 7,025,074 B2 | 4/2006 | Porter | |
| 7,240,684 B2 | 7/2007 | Yang | |
| 7,546,844 B2 | 6/2009 | Al-Mutairi | |
| 8,336,568 B1 * | 12/2012 | Belden | 135/88.06 |
| 8,453,996 B1 | 6/2013 | Papadopoli et al. | |
| 8,607,810 B1 | 12/2013 | Chung | |

OTHER PUBLICATIONS

"E-Z UP® 8×12 Speed Shelter® II Canopy Product Information", http://www.hayneedle.com/product/12×8speedshelterezupsteelframecanopy.cfm, accessed Feb. 24, 2014.

"Park Smart Parking Mat Product Information", http://www.organizeit.com/park-smart-parking-mat-yellow.asp, accessed Feb. 24, 2014.

* cited by examiner

*Primary Examiner* — Noah Chandler Hawk
(74) *Attorney, Agent, or Firm* — Law Office of Mark Brown, LLC; Christopher M. DeBacker; Mark E. Brown

(57) ABSTRACT

An automobile display canopy with an anchor system for securing the canopy to the ground using the automobile itself. The general components of the present invention are a collapsible canopy including at least four canopy legs, and four anchor platforms which hold the canopy in place and allow a vehicle to drive onto the plates, thereby securing the entire system to the ground. The anchors may include a single tire stop, signaling to the driver when the wheel reaches a stopping point. An alternative embodiment may include both a front stop and a rear stop. The legs of the canopy must be collapsible. They may telescope or be disassembled temporarily.

7 Claims, 9 Drawing Sheets

AUTOMOBILE DISPLAY CANOPY AND ANCHOR SYSTEM

CROSS-REFERENCE TO RELATED APPLICATIONS

This application is a continuation-in-part of and claims priority in U.S. patent application Ser. No. 14/085,524, filed Nov. 20, 2013, which is incorporated by reference.

BACKGROUND OF THE INVENTION

1. Field of the Invention

The present invention is related generally to an automobile display canopy with a specialized anchoring system, and more particularly to a canopy which is anchored by plates secured by the wheels of an automobile while providing optimal viewing display of the vehicle in a car-show setting.

2. Background and Description of the Related Art

Car shows and other automobile-related events typically feature a large outdoor space where a number of vehicles are on display for the viewing public and other automobile enthusiasts. Ideal weather for such events is a sunny, warm, clear day. This can result in the sun beating down on the expensive custom paint job of a prized automobile for hours at a time. Additionally, rain or other inclement weather can appear at any time. Vehicle owners desire to protect their vehicles from the sun and other weather effects, but often this is impossible during auto-show settings.

Currently, if a person wants to protect their vehicle from the elements, they would have to put their vehicle into a garage or shed, cover their vehicle with a tarp or soft cover, or use a common patio tent. However, these means of vehicle protection do not facilitate the display of vehicles at auto-shows. Permanent garages and sheds cannot be transported to show sites, and would make it difficult for viewers to see the vehicle stored within. Similarly, tarps and soft covers conceal the car completely, and therefore are not suitable for protecting a vehicle at a car show or event.

While some auto enthusiasts use collapsible patio tents more commonly seen at sporting tailgate events, there are several problems with these tents. First, they are not typically intended for setup on pavement or concrete, where automobiles would typically be parked. Because of this, a tent set up at a car show has a high likelihood of being blown over in the wind. The long metal legs of such tents pose serious danger to the paint and finish of these highly cared-for vehicles at car shows. If such a tent were to blow over, several vehicles could be damaged. Typical means of anchoring these tents have not solved this issue. For this very reason, such tents are banned at most, if not all, car show events. Even still, existing collapsible tents are typically not large enough to accommodate vehicles for these purposes.

What is desired is a canopy that may be anchored by the automobile itself, is customizable for automobiles of any size, and which is highly portable. Heretofore there has not been available an automobile display canopy with the advantages and features of the present invention.

SUMMARY OF THE INVENTION

The present invention is an automobile canopy with an anchor system for securing the canopy to the ground using the automobile itself. The general components of the present invention are a collapsible canopy including at least four canopy legs, and four anchor platforms which hold the canopy in place and allow a vehicle to drive onto the plates, thereby securing the entire system to the ground.

The anchors may include a single tire stop, signaling to the driver when the wheel reaches a stopping point. An alternative embodiment may include both a front stop and a rear stop. The legs of the canopy must be collapsible. They may telescope or be disassembled temporarily.

An alternative embodiment anchor would include several mounting slots for mounting the base of the canopy legs to accommodate larger and smaller vehicles.

BRIEF DESCRIPTION OF THE DRAWINGS

The drawings constitute a part of this specification and include exemplary embodiments of the present invention and illustrate various objects and features thereof.

DETAILED DESCRIPTION OF THE PREFERRED EMBODIMENT

I. Introduction and Environment

As required, detailed aspects of the disclosed subject matter are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Said terminology will include the words specifically mentioned, derivatives thereof and words of similar meaning.

A preferred embodiment of the present invention provides an automobile display canopy 2 featuring four anchors 4 which allow the canopy to be deployed around the vehicle 6 while being anchored to the ground by the vehicle 6 such that the canopy will not blow over causing damage to the vehicle 6 or other vehicles in the vicinity.

II. Embodiment or Aspect of the Vehicle Display Canopy 2 Having Anchors 4

Figure 1:
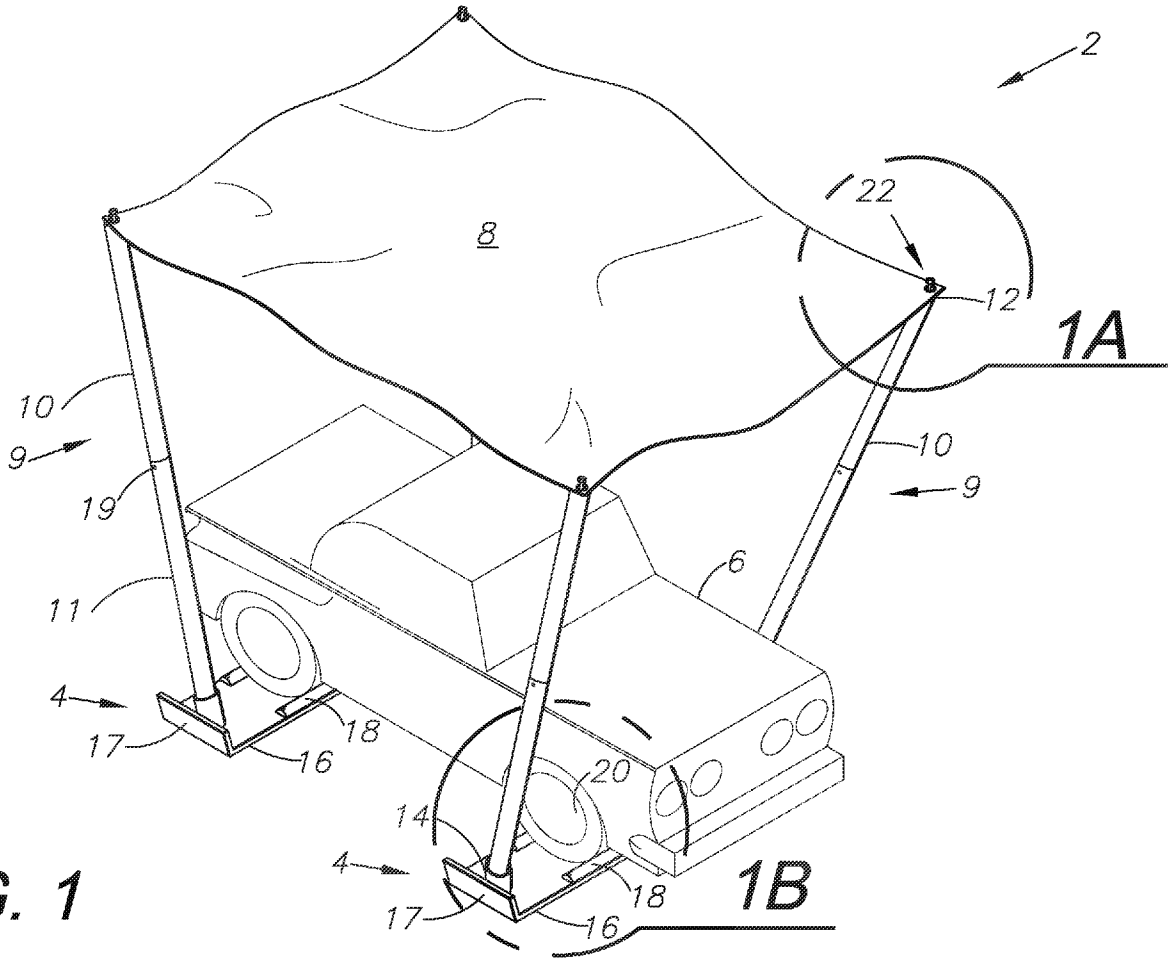
FIG. 1 is an isometric view of a preferred embodiment of the present invention incorporated into a typical environment.

As shown in FIG. 1, the canopy 2 includes a number of collapsible legs 9, four anchor plates 4, a canopy covering 8 and connections 22 between the covering 8 and the legs 9. In a preferred embodiment, each of the legs 9 is separated into at least two portions, shown in FIG. 1 as a top portion 10 and a bottom portion 11. The two portions are connected by a pin 19. Alternatively, the legs 9 could be telescoping legs that lock into place when extended. Other means of combining leg portions together could be used as well, such as joining two threaded ends together or using a temporary fastener.

The bottom portion 11 of each leg 9 is pinned into a receiver 14 of an anchor 4. The receiver 14 is welded to a toe 17 which is formed by a mechanical break in the base plate 16 of the anchor 4. Each plate also includes one or two tire stops 18 which make contact with the tires 20 of the vehicle 6 being protected and displayed under the canopy 2. If the anchor 4 employs a single stop 18, it would be located toward the front edge of the base plate 16. Once the tire makes contact with the stop, the driver is notified by the impact that the tire is fully located on the anchor 4. In the case of two stops 18, the driver would drive over the first stop such that the tire is located between both stops (see FIGS. 3 and 4). The cross section of a stop could vary in shape. A triangular cross section, half-moon cross section, or even square or rectangular cross section would suffice.

The covering 8 is intended to protect the vehicle 6 from the sun. Car shows may last all day long, and the sun can cause paint to fade and wear. Paint jobs on show-cars can be extremely expensive, and car owners want to protect their vehicles from any and all elements. Similarly, the covering could be waterproof to protect the vehicle from rain. The cover could partially or fully roll down the sides of the canopy 2, snapping to or otherwise being connected to the legs to form an enclosed tent.

The canopy 2 would cast a shadow around the vehicle, depending on the sun's position in the sky. Chairs could be placed in the shaded area provided by the canopy. As the sun moves, the shade may shift, and chairs could be moved to follow this shaded space.

Figure 1A:
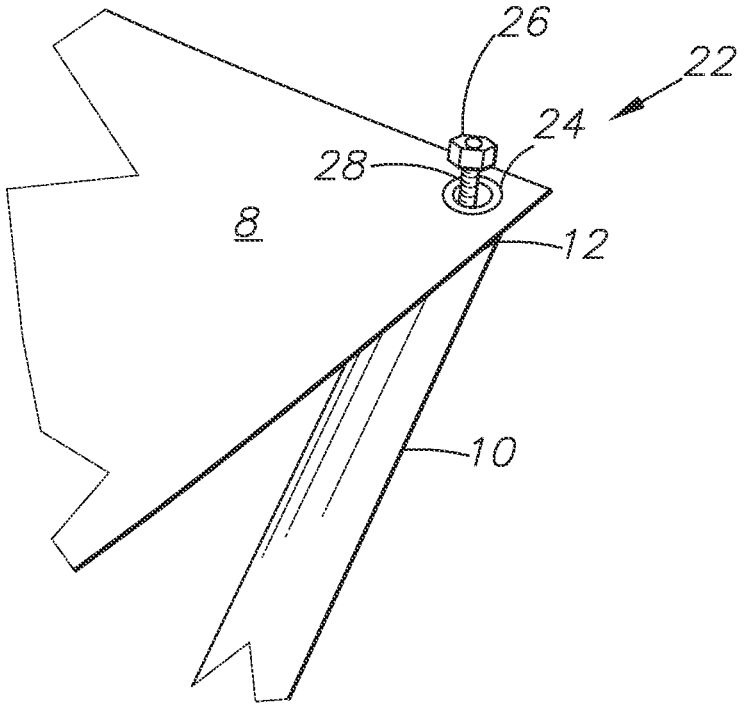
FIG. 1A is a detailed isometric view taken about the circle 1A of FIG. 1.
Figure 6:
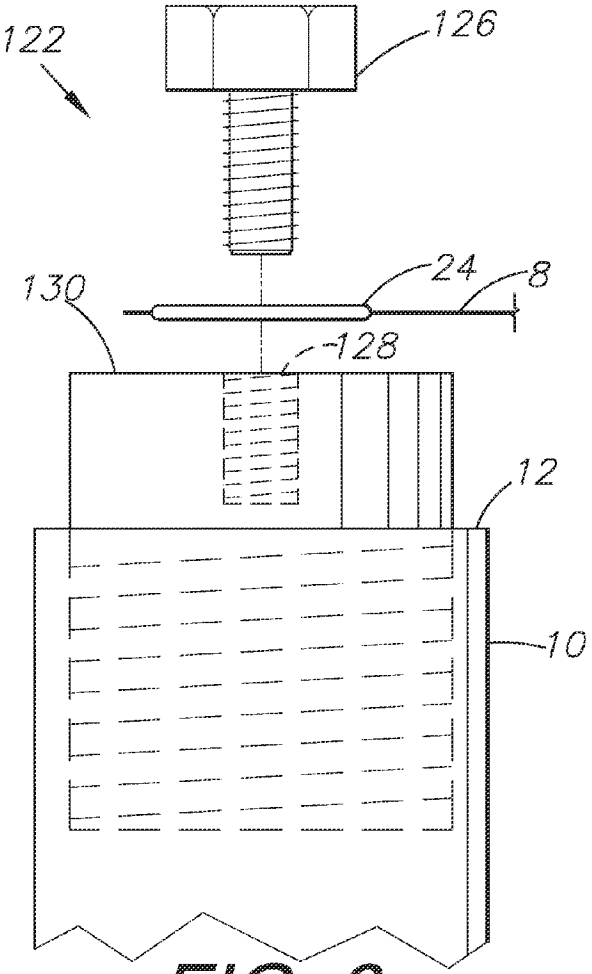
FIG. 6 is a side elevational view detailing an alternative embodiment thereof.
Figure 5:
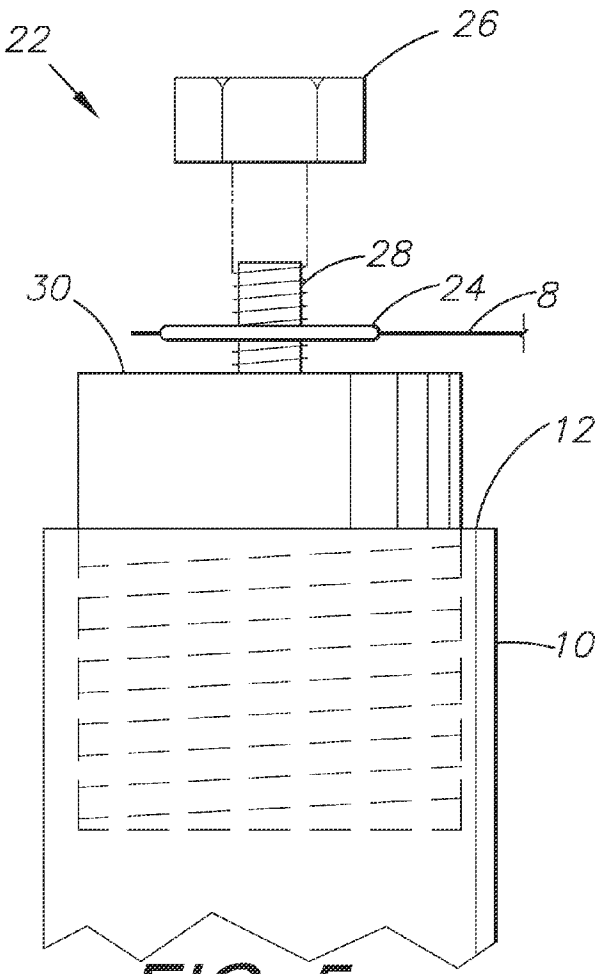
FIG. 5 is a side elevational view detailing the connection at the end of a pole element comprising one of the canopy legs, which is an element of a preferred embodiment of the present invention.

FIG. 1A shows the connection 22 between the cap 12 of the upper portion 10 of a leg 9 with the canopy covering 8. A grommet 24 is located at each corner of the covering 8. As shown in FIG. 1A, a threaded post 28 connected to or inserted into the cap 12 of the upper leg portion 10 is inserted through the grommet 24 and a threaded nut 26 is used to fasten the cover 8 to the leg 9. FIGS. 5 and 6 show two alternative connecting means in more detail, although these are not the only means by which the cover 8 may be connected to the legs 9.

Figure 1B:
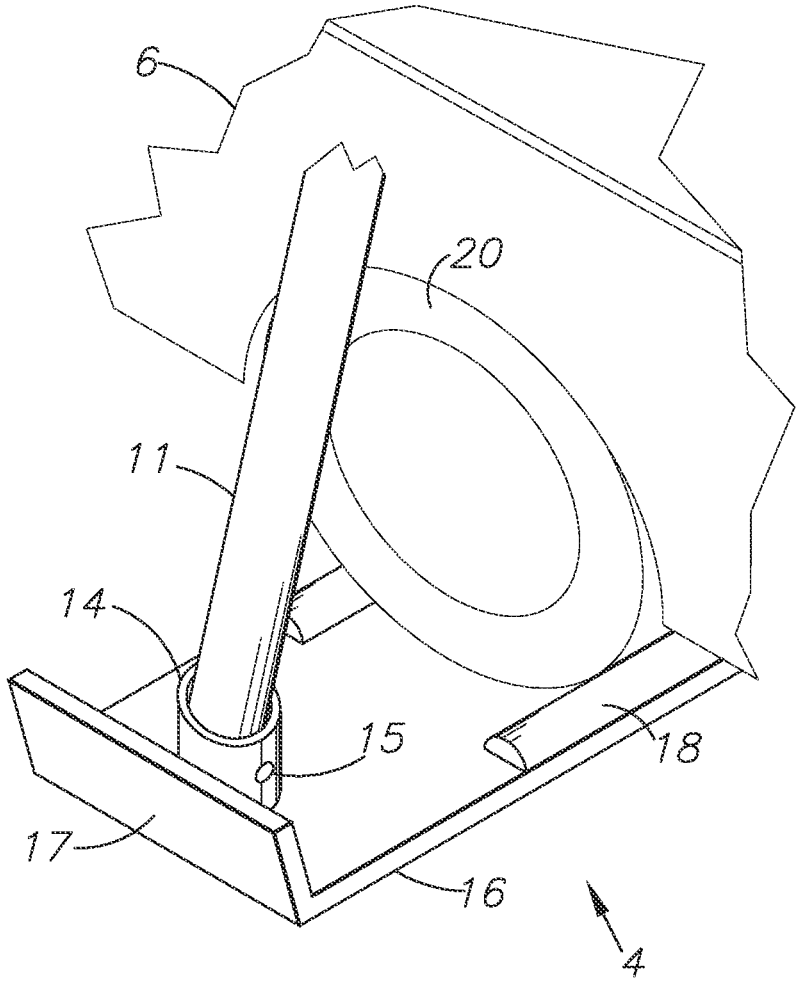
FIG. 1B is a detailed isometric view taken about the circle 1B of FIG. 1.

FIG. 1B shows the connection between the lower leg portion 11 and the anchor 4 in more detail. Specifically, it shows how the lower leg portion 11 is pinned into the receiver 14 using a removable pin 15. The pin could be a cotter pin or any other type of connecting means for securing the leg 9 to the anchor 4 while the canopy 2 is in use. The function of the anchor 4 is to use the vehicle's 6 own weight to hold down the canopy 2, preventing it from blowing over in the wind, which could potentially damage the vehicle 6 or other vehicles in the vicinity. FIG. 1B also shows how the tire 20 could be trapped between two stops 18, securing the vehicle tire squarely onto the anchor.

Figure 2:
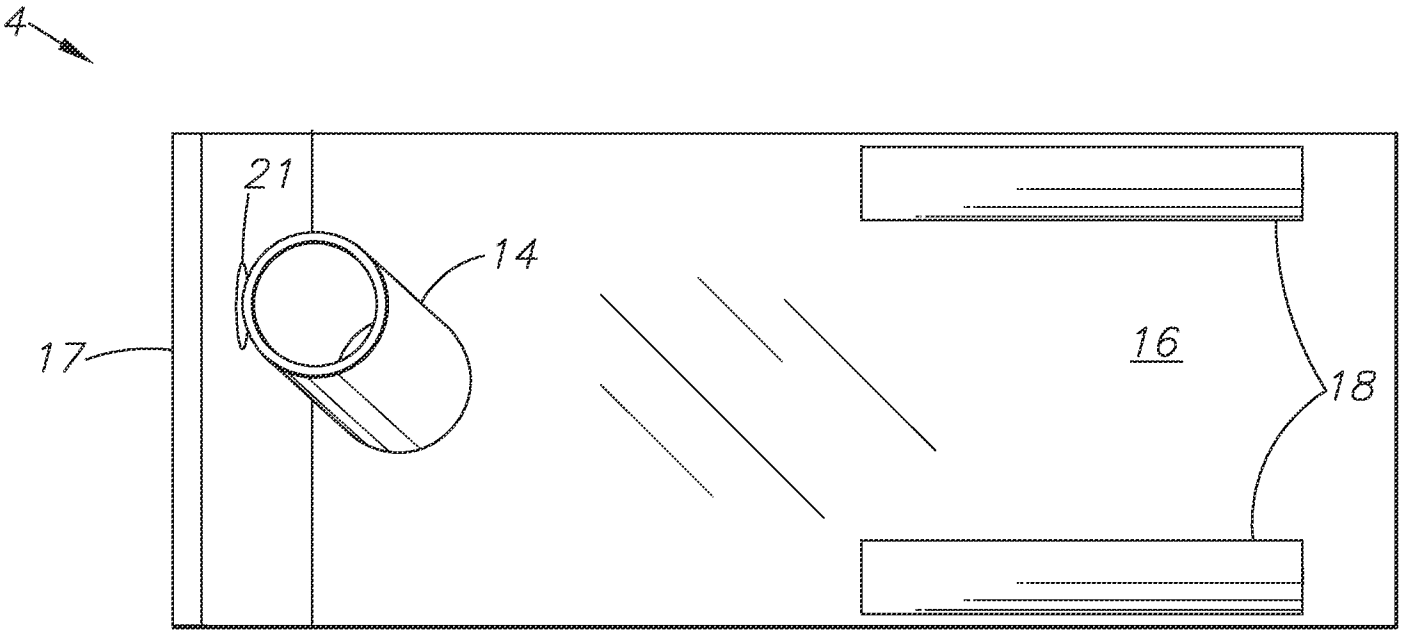
FIG. 2 is a top plan elevation of an anchor plate embodying an element of a preferred embodiment of the present invention.
Figure 3:
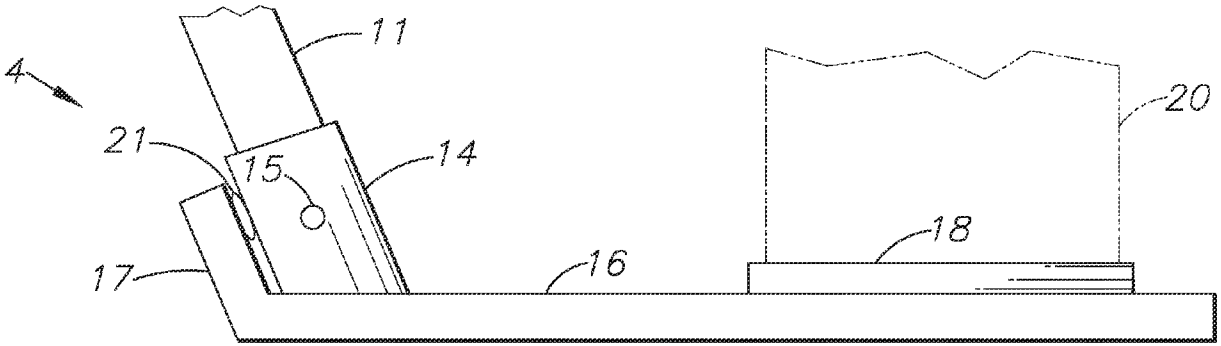
FIG. 3 is a side elevational view thereof.
Figure 4:
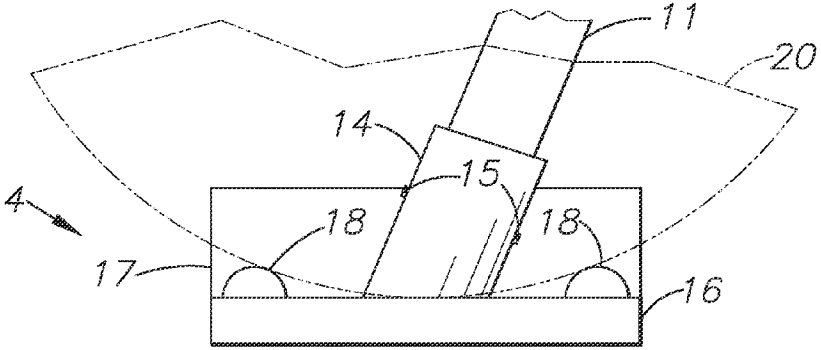
FIG. 4 is a front elevational view thereof.

FIG. 2 shows how the receiver 14 is welded to the toe 17. The base plate 16 is broken in the manufacturing process to form the toe 17, which adds structural stability to the anchor 4 and provides additional surface area for welding the receiver 14. FIG. 3 shows the receiver 14 connected to the toe 17 via spot weld 21. FIGS. 3 and 4 provide additional detail of the anchor 4, showing how the tire 20 interacts with the stops 18.

FIG. 5 shows an embodiment of the connection 22 between the upper leg portion 10 and the grommet 24 which is connected to the covering 8. A plug 30 is threaded into the cap 12 of the upper leg portion 10. The embodiment shown in FIG. 5 includes a threaded post 28 extending from the plug 30. The post 28 is inserted through the grommet 24 and a threaded nut 26 is threaded onto the post 28, securing the grommet 24, and thus the cover 8, to the upper leg portion 10.

FIG. 6 shows an alternative embodiment connection 122. Again, a plug 130 is threaded into the cap 12 of the upper leg portion 10. The plug 130 includes a threaded receiver 128. A threaded bolt 126 is inserted through the grommet 24 and is threaded into the receiver 128, thereby securing the grommet 24, and thus the cover 8, to the upper leg portion 10.

Any other conceivable means of securing the cover 8 to the upper leg portion could also be used. For example, a simple hook, clasp, or carbineer could be used to connect the grommet 24 to a hook or loop located or connected to the cap 12 of the upper leg portion 10. Similarly, bungee cords or ties could be used.

III. Alternative Embodiment Anchor 104

Figure 7:
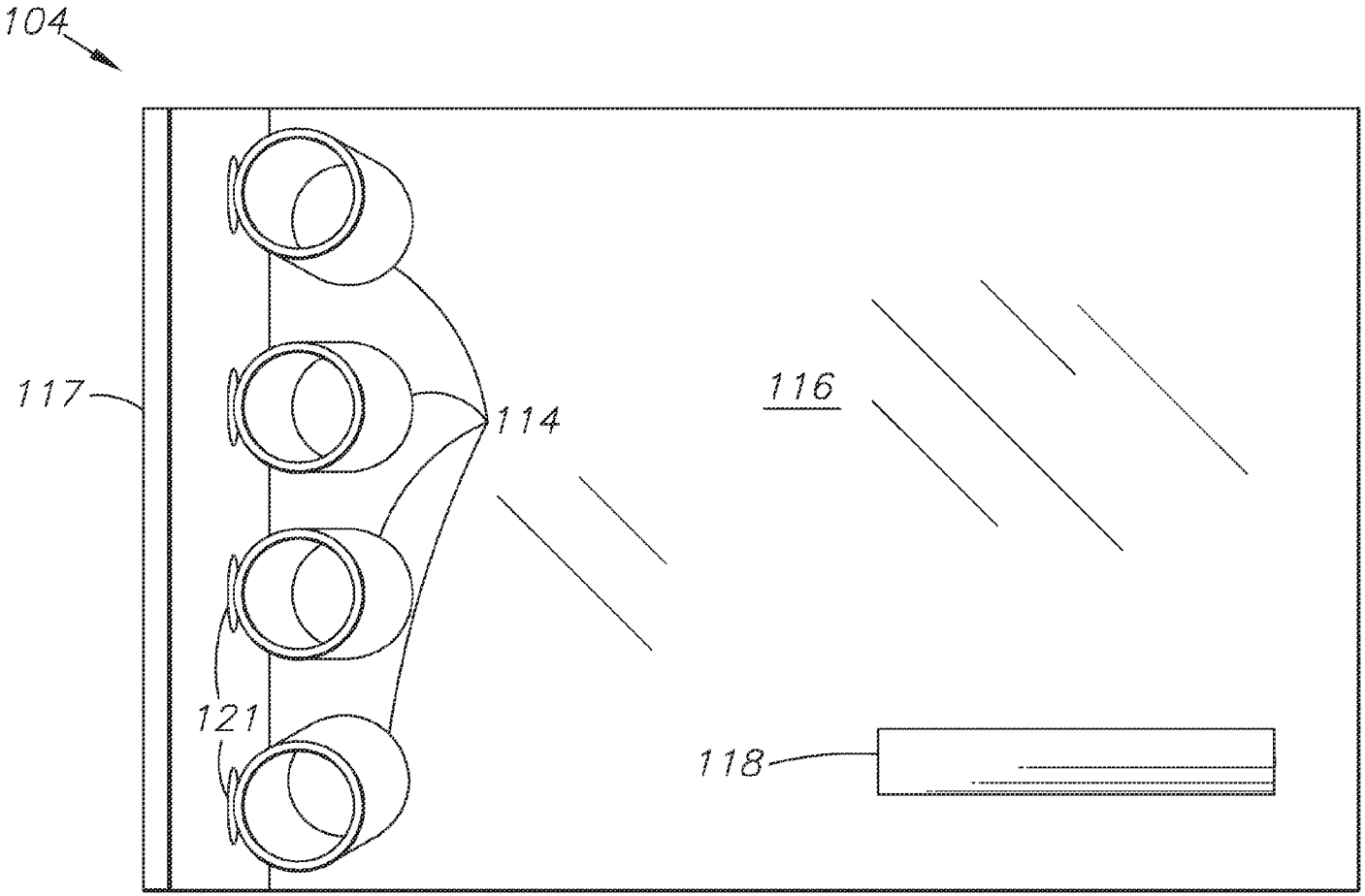
FIG. 7 is a top plan view of an alternative embodiment anchor plate embodying an element of an alternative embodiment of the present invention.
Figure 9:
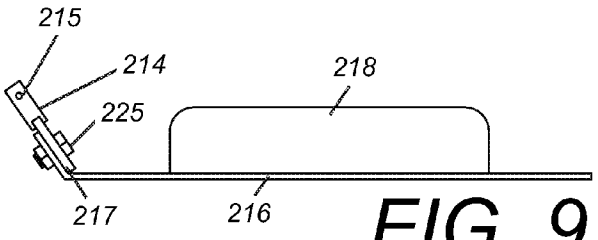
FIG. 9 is a side elevational view thereof.
Figure 10:
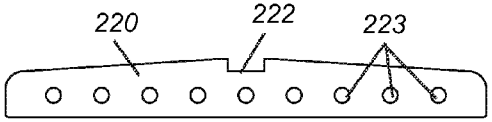
FIG. 10 is a rear elevational view thereof.

FIG. 7 displays an alternative embodiment of the anchor 104 which may be used with the same legs 9 and canopy cover 8 as the system described above.

The wheelbase of vehicles can range from around 112 inches to around 129 inches. Thus it may be necessary for a system to accommodate multiple vehicles using the same anchors 104, legs 9, and cover 8. The embodiment shown in FIG. 7 includes a single wheel stop 118 as discussed above. The base plate 116 features a similar break forming a toe 117. Four receivers 114 are shown aligned along the break and welded to the toe 117 via spot welds 121. The receivers are shown facing in different directions to further accommodate the different wheel-base lengths of different automobiles; however, they could all point out in the same direction.

Four receivers 114 are shown, however as few as two may be used or as many as are necessary to accommodate all vehicle types. Alternatively, a single receiver on a sliding track may be used. The sliding track could be locked in place against the plate 116, unlocked and slid into a new position accommodating a larger or smaller vehicle, and then re-locked in the new position.

IV. Alternative Embodiment Display Canopy 202 with Anchor 204

Yet another alternative embodiment display canopy system 202 with anchor 204 is shown in FIGS. 8-11. This embodiment includes several features which add strength and utility to the embodiments disclosed above.

Figure 8:
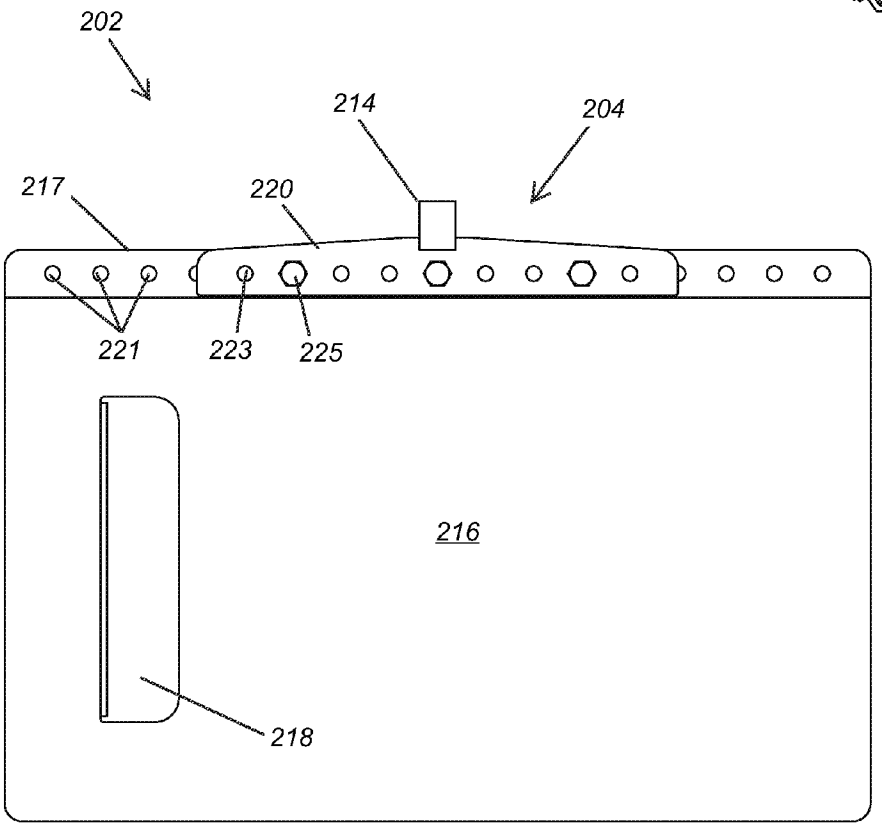
FIG. 8 is a top plan view of another alternative embodiment anchor plate embodying an element of an alternative embodiment of the present invention.

FIG. 8 shows an anchor 204 having a base plate 216 including a toe 217 featuring several bolt holes 221. The entire plate 216 and toe 217 are laser cut from a single piece of aluminum or other suitable metals. Aluminum is ideal for weight and functionality. The base plate is further laser cut to form the detent 218 which acts as a wheel stop. The detent 218 is broken from the base plate 216 using a press break. This provides the most affordable and effective way of placing a wheel stop on the anchor 204.

A selectable receiver plate 220 is bolted to the toe 217 via several bolts 225 passing through a set of bolt holes 223 located on the receiver plate 220 along with the bolt holes 221 located on the toe.

A leg post 214 is inserted into a notch 222 of the receiver plate 220 and welded into place. The post is a solid roll pin which slots over the notch via a cap in the receiver, and includes a pin hole 215 for receiving a pin. A leg segment 210 of the canopy 202 is placed over the leg post 214, and a pin is inserted through the leg and the receiver, thereby locking the leg to the anchor 204. Again, the leg segments 210 would ideally be aluminum, though other suitable metals could also be used.

Figure 11:
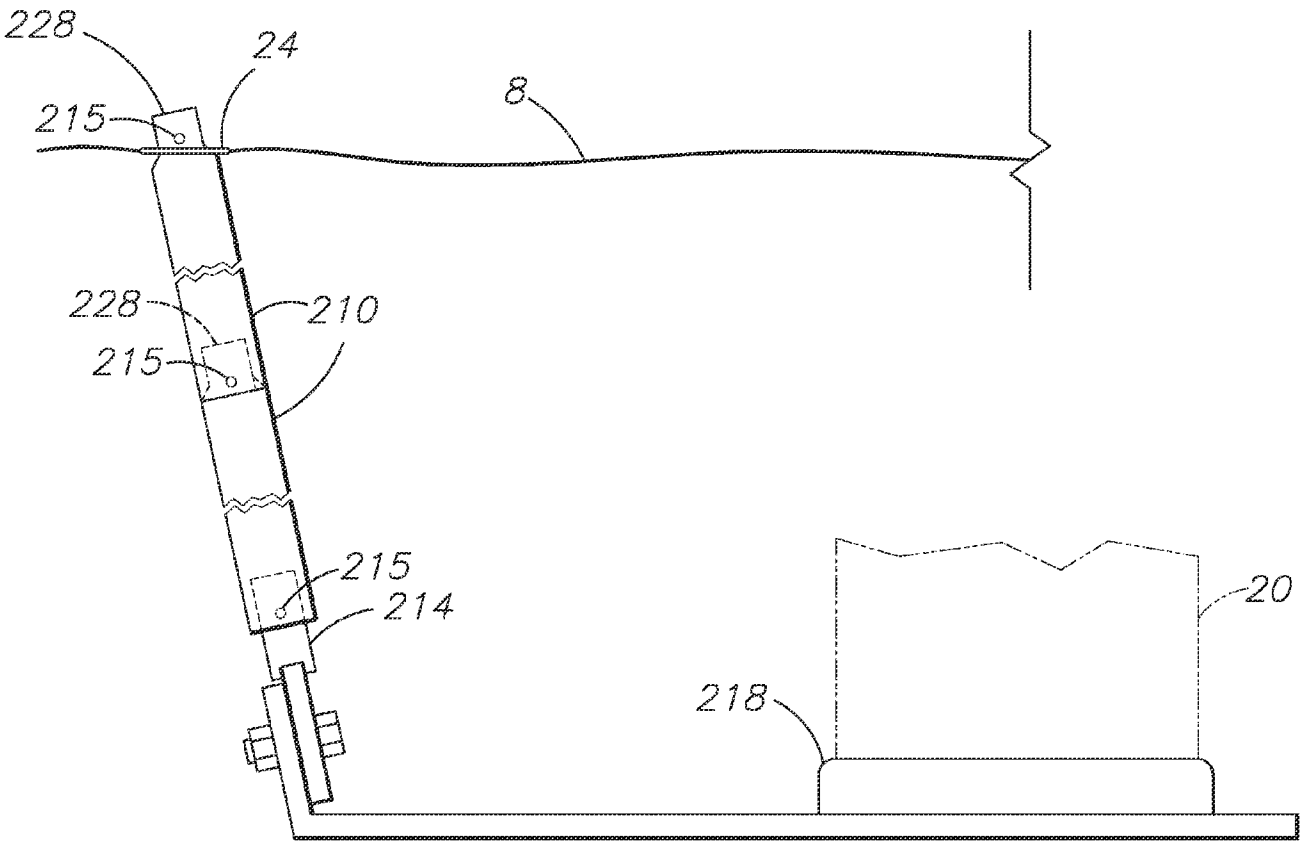
FIG. 11 is a diagrammatic side elevational view of the alternative embodiment of the present invention.

As shown in FIG. 11, a preferred embodiment includes at least eight leg segments 210, which allows for two segments per leg. The segments are interchangeable and fit together using a connecting post 228 and a pin in the same way that a leg portion 210 connects with the leg post 214. The connecting post 228 ideally is simply a swedged end of the leg portion 210, although the post 228 could be a separate element. The connecting post 228 of the top-most leg segment 210 is fitted through the grommet 24 of the canopy 8 and a pin is used to prevent the grommet 24 from slipping off of the post 228. As the leg portions 210 are interchangeable, any such leg portion could connect to the leg post 214 or the grommet 24.

It is to be understood that while certain aspects of the disclosed subject matter have been shown and described, the disclosed subject matter is not limited thereto and encompasses various other embodiments and aspects.

Having thus described the invention, what is claimed as new and desired to be secured by Letters Patent is:

1. A canopy system for accommodating a vehicle, the system comprising:

a rectangular cover including a grommet located at each corner of said cover;

a leg comprising a generally tubular shape, said leg comprised of a first leg portion and a second leg portion, wherein each of said first and second leg portions are identically shaped and sized;

each of said first and second leg portions respectively comprising a proximal end and a distal end, said proximal end including a connector receiver having a pin hole, and said distal end including a leg connector having a pin hole;

an anchor comprising a base plate, a toe, and a wheel stop;

said wheel stop comprised from a portion of said base plate which has been laser cut and bent away from said base plate at an angle between 60 degrees and 90 degrees, and wherein said wheel stop is configured to impede a wheel of the vehicle;

a toe portion of said base plate bent at an angle between 30 degrees and 90 degrees, said toe portion including a plurality of mounting bolt holes;

a receiver plate including a plurality of mounting bolt holes corresponding to the bolt holes of said toe portion;

said receiver plate being selectively mounted to said toe portion via a plurality of bolts threaded through said respective bolt holes;

a leg post welded to said receiver plate, said leg post including a pin hole, and said leg post having generally the same size and shape as said leg connector; and a first connecting pin connecting the connector receiver of said first leg portion to said leg post, a second connecting pin connecting said leg connector of said first leg portion to said connector receiver of said second leg portion, and a third connecting pin connecting said leg connector of said second leg portion to said cover, wherein said leg connector of said second leg portion is inserted through one of said grommets.

2. The system of claim 1, wherein the distal end of each said leg portion is swedged, thereby forming said leg connector.

3. The system of claim 1, wherein said base plate, said receiver plate, and said leg portions are comprised of aluminum.

4. The system of claim 1, further comprising:

wherein said leg connector comprises a threaded plug, a top face, and a threaded protrusion protruding from said top face;

wherein each said distal end of each said leg portion comprises a threaded receiver adapted for receiving a respective leg connector;

wherein said threaded protrusion is inserted through a respective grommet; and wherein a nut is threaded onto said threaded protrusion.

5. The system of claim 1, further comprising:

wherein said leg connector comprises a threaded plug, a top face, and a threaded receiver penetrating centrally into said top face;

wherein each said distal end of each said leg portion comprises a threaded receiver adapted for receiving a respective connector;

inserting a threaded bolt through a respective grommet; and threading a respective threaded bolt into each respective connector at each said threaded receiver.

6. A canopy system comprising:

a rectangular cover including a grommet located at each corner of said cover;

four legs, each leg comprising a generally tubular shape, and each said leg comprised of a first leg portion and a second leg portion, wherein each of said first and second leg portions are identically shaped and sized;

each of said first and second leg portions respectively comprising a proximal end and a distal end, said proximal end including a connector receiver having a pin hole, and said distal end including a leg having a swedged shape forming a connector having a pin hole;

four anchors, each comprising a base plate and a wheel stop;

each said wheel stop comprised from a portion of said base plate which has been laser cut and bent away from said base plate at an angle between 60 degrees and 90 degrees, and wherein said wheel stop is configured to impede a wheel of the vehicle;

each said anchor further including a toe portion comprising an end of said base plate bent at an angle between 30 degrees and 90 degrees, each said toe portion including a plurality of mounting bolt holes;

each said anchor further including a receiver plate including a plurality of mounting bolt holes corresponding to the bolt holes of a respective said toe portion;

each said receiver plate being selectively mounted to said respective toe portion via a plurality of bolts threaded through said respective bolt holes;

each said receiver plate including a leg post welded to said receiver plate, said leg post including a pin hole, and said leg post having generally the same size and shape as said each leg connector; and connecting pins connecting the connector receivers of said first leg portions to respective said leg posts, said leg connectors of said first leg portions to said connector receivers of respective said second leg portions, and said leg connectors of said second leg portions to said cover, wherein said leg connectors of said second leg portions are inserted through a respective one of said grommets.

7. The system of claim 6, wherein each said base plate, each said receiver plate, and each said leg portion are comprised of aluminum.

* * * * *